United States Patent [19]

Held

[11] Patent Number: 4,646,603

[45] Date of Patent: Mar. 3, 1987

[54] LOWER CUTTER OF AN APPARATUS FOR LONGITUDINALLY SLITTING A WEB

[75] Inventor: Franz Held, Gross-Zimmern, Fed. Rep. of Germany

[73] Assignee: Maschinenfabrik Goebel GmbH, Darmstadt, Fed. Rep. of Germany

[21] Appl. No.: 865,367

[22] Filed: May 21, 1986

[30] Foreign Application Priority Data

May 25, 1985 [DE] Fed. Rep. of Germany ..... 3518922

[51] Int. Cl.[4] ..... B26D 7/26; B26D 1/15

[52] U.S. Cl. ..... 83/425.4; 83/499; 83/504; 83/665

[58] Field of Search ..... 83/665, 498, 499, 504, 83/425.4

[56] References Cited

U.S. PATENT DOCUMENTS

| | | | |
|---|---|---|---|
| 3,073,198 | 1/1963 | Clem | 83/665 X |
| 3,422,714 | 1/1969 | Gompel et al. | 83/498 |
| 3,583,270 | 6/1971 | Webb | 83/433 |
| 3,951,024 | 4/1976 | Weiskopf | 83/498 |
| 4,033,217 | 7/1977 | Flaum et al. | 83/425.4 |
| 4,211,135 | 7/1980 | Wehde | 83/499 |

FOREIGN PATENT DOCUMENTS 1038902 9/1958 Fed. Rep. of Germany .

*Primary Examiner*—Donald R. Schran
*Attorney, Agent, or Firm*—Watson, Cole, Grindle & Watson

[57] ABSTRACT

The lower cutter of an apparatus for longitudinally slitting a continuous web is mounted for axial displacement along its support shaft to some desired position by the provision of one or more axial first slots provided in the outer periphery of the shaft, a fitting received in each slot underlying the cutter and fastened thereto, and roller bearings between and in contact with the undersurface of the fitting and the bottom of each first slot. One or more second slots are provided in the shaft periphery each receiving a pressure bar bearing against the undersurface of the cutter, and an expandable tube or pillow between the pressure bar and the bottom of the second slot is expanded for fixing the lower cutter in place after axial displacement.

3 Claims, 3 Drawing Figures

LOWER CUTTER OF AN APPARATUS FOR LONGITUDINALLY SLITTING A WEB

BACKGROUND OF THE INVENTION

This invention relates generally to an apparatus having upper and lower cooperating cutters for longitudinally slitting a travelling web of paper, foil, cloth, plastic, metal or like material, the lower cutter or cutters being set in a desired position along the shaft thereof.

U.S. Pat. No. 3,583,270 discloses a slitter apparatus for traveling webs in which the lower cutters are driven by their own motors and are capable of being shifted over the width of the web to be cut to the desired position by means of an air cushion introduced to provide air bearings between the motor platform and transversely extending rails.

West German Pat. No. 10 38 902 also discloses a web slitting apparatus in which the lower cutters are displaceable axially on the shaft to which they are mounted for selecting different cutting widths, the lower cutters being in the shape of so-called cutting boxes having a plurality of cutting grooves presenting a series of spaced cutting edges. The cutting boxes are capable of being axially displaced a distance equal to at least the spacing between adjacent cutting edges. An annular, expandable tube is contained within each lower cutter which must be displaced together with the cutter during the shifting adjustment along the shaft. Thus, it becomes difficult to axially shift the lower cutters without binding or snagging caused by the embedded expandable annular tubes. Moreover, since the tubes are expandable in an uncontrollable manner the lower cutters could very easily be cocked on their support shaft thereby resulting in one or more lower cutters rotating about an axis at an angle to the rotational axis of its supporting shaft. Such results in an uneven quality of cut which is undesirable.

If, on the other hand, the expandable tubes of the aforementioned West German patent were embedded in annular grooves provided in the support shaft to avoid some of these problems, such annular grooves would only tend to weaken the shaft and cause it to sag when applying even negligible forces. The expandable tubes must therefore be positioned on the outer periphey of the hollow bearing shaft.

SUMMARY OF THE INVENTION

It is an object of the present invention to provide a lower cutter of an apparatus for longitudinally slitting a web in which the cutter is capable of being shifted axially along its support shaft smoothly and accurately while avoiding any slippage between the cutter and its support shaft during shaft rotation and being securely fixed at its adjusted location at any desired position.

In carrying out this general objective, at least one axially extending, outwardly open, flat bottom first groove is provided in the outer periphery of the lower cutter support shaft, a fitting is received in the groove and extends slightly outwardly thereof, the cutter overlies the fitting and is secured thereto for rotation together with the shaft. A roller supporting cage is located between and in contact with an inner surface of the fitting and the bottom of the groove to facilitate displacement of the cutter and the fitting in an axial direction of the shaft, the cage in such axial direction being shorter than the length of the cutter by an amount equal to at least the spacing between an adjacent pair of cutting edges of the lower cutter, so that the cage will not extend outwardly of either end of the cutter upon cutter displacement in the axial direction.

The lower cutter of the present slitting apparatus also has at least one axially extending, outwardly open, second groove in the outer periphery of its shaft, a pressure bar being received in this second groove and extending slightly outwardly thereof. The cutter overlies this bar, and an expandable element is located in the second groove underlying the pressure bar for pressing the bar, upon expansion, against the cutter for preventing any axial shifting of the cutter after being set along its support shaft.

Other objects, advantages and novel features of the invention will become more apparent from the following detailed description of the invention when taken in conjunction with the accompanying drawings.

DETAILED DESCRIPTION OF THE INVENTION

Figure 1:
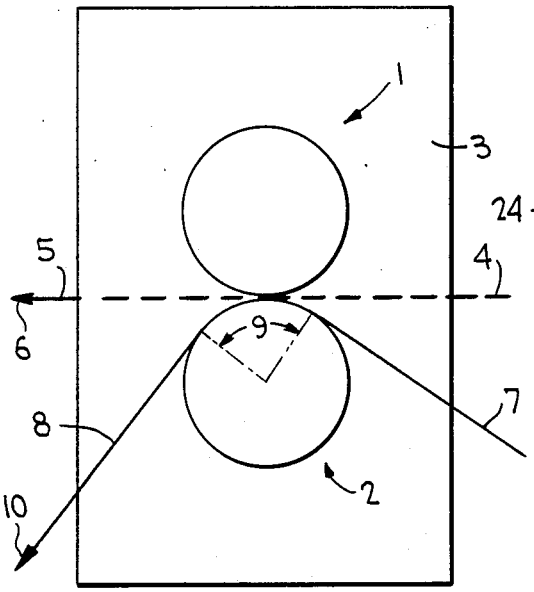
FIG. 1 is a schematic view, in end elevation, of upper and lower coacting cutters of an apparatus for longitudinally slitting a web.

Turning now to the drawings wherein like reference characters refer to like and corresponding parts throughout the several views, at least one upper cutter generally designated 1 and at least one lower cutter generally designated 2 are journalled at opposite ends in any normal manner for rotation in a machine frame 3. The machine frame includes a pair of parallel side walls between which the support shafts of the upper and lower cutters are rotatably mounted at their ends. A plurality of upper and lower cutters are typically mounted on their respective shafts end-to-end so that a travelling web may be slit longitudinally into the desired number of strips. Each upper cutter comprises a slitting blade coacting with one of the cutting grooves of the lower cutter in a manner generally known in this art.

Thus, web 4, for example, unwound from an unwinding apparatus (not shown) is slit by the coacting cutters 1 and 2 into several strips 5 which, when viewed in FIG. 1, lie one behind the other. The strips proceed from the cutting apparatus in the direction of arrow 6 for feeding into a web rewind apparatus (not shown).

As seen in FIG. 1, the path of web 4, illustrated in dashed outline, and strips 5 cut from the web, is essentially horizontal, i.e. "straight." However, web 7, illustrated in solid outline, and strips 8 cut from the web, pass partially about lower cutter 2 through an angle 9, thus representing a so-called looped cut. Strips 8, located one behind the other when viewed in FIG. 1, leave the cutting apparatus in the direction of arrow 10 and proceed to the rewind apparatus.

Figure 2:
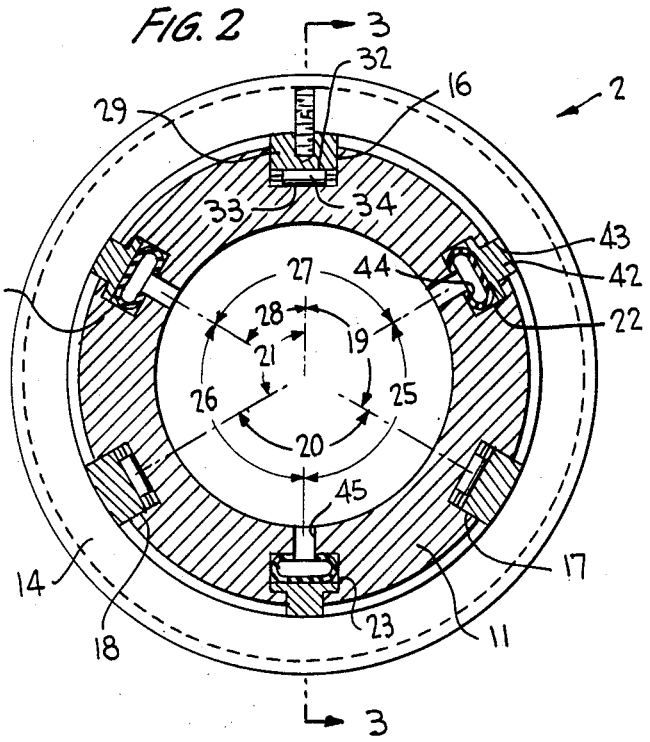
FIG. 2 is a cross-sectional view of the lower cutter mounted on its support shaft in accordance with the invention, taken substantially along the line 2—2 of FIG. 3.
Figure 3:
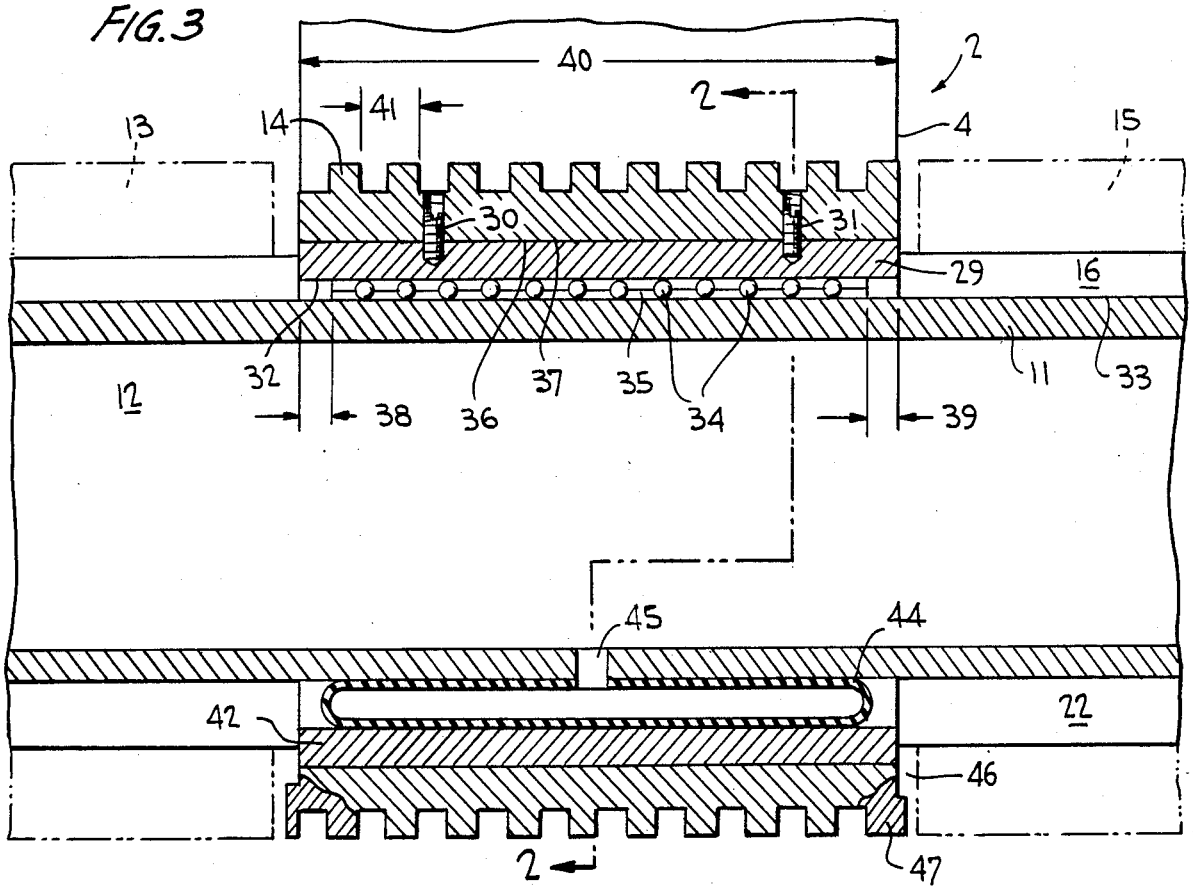
FIG. 3 is a longitudinal sectional view of the lower cutter mounted on its support shaft, taken substantially along the line 3—3 of FIG. 2.

The details of the lower cutter, mounted for axial displacement in accordance with the invention, are shown in FIGS. 2 and 3. The lower cutter is mounted on a hollow support shaft 11 having a central supply passage 12 through which a pneumatic or hydraulic pressure medium is fed in any normal manner from a source, not shown. This supply passage can have a significantly smaller diameter than shown.

Box-shaped lower cutters, so-called cutting boxes (cutting bushes) 13, 14 and 15, are mounted on shaft 11 in such a manner as to be supported by the shaft. The cutting boxes together form lower cutter 2, schematically shown in FIG. 1. Instead of three cutting boxes, the outer two being shown in FIG. 3 in phantom outline, several more or only one or two cutting boxes may be mounted on shaft 11 without departing from the invention.

As shown in FIG. 2, a plurality of axially extending, outwardly open, flat bottom first grooves 16, 17 and 18 are provided in the outer periphery of shaft 11. These first grooves are radially spaced apart lying at relative equal angles 19, 20 and 21 of 120° to each other. And, a plurality of axially extending, outwardly open second grooves 22, 23 and 24 are likewise provided in the outer periphery of shaft 11, spaced apart at equal angles of 120° to each other as represented at 25, 26 and 27. And, the three first grooves respectively lie at 60° angles relative to the three second grooves in a circumferential direction.

Although three first and three second grooves are shown, only one of each such grooves is required and two, four or more grooves of each type may be provided so that the corresponding angles between them are changed accordingly.

A fitting 29, of a length substantially the same as the length of its respective lower cutter (FIG. 3) is received in each of the first grooves and extends partially out of that groove, as shown in FIG. 2. Cutting box 14 overlies this fitting and is securely fastened thereto by screw fasteners 30 and 31, for example such that the cutting box and its fitting rotate together upon rotation of shaft 11. And, the cutting box and its shaft are likewise displaced together when moved in an axial direction of the shaft by any normal means, not shown.

A plurality of anti-friction bearings 34, which may be in the form of needle bearings, roller bearings, ball bearings, or the like, are maintained a predetermined distance apart by means of a flat roller bearing cage 35 which receives the rollers. The cage and its bearings are disposed between and in contact with inner surface 32 of fitting 29 and bottom surface 33 of first groove 16. In order to assure intimate contact between the roller bearings and these surfaces, inner surface 36, or at least a part thereof, of cutting box 14 and outer surface 37 of fitting 29 can be slightly slanted relative to each other in the form of a wedge to facilitate precision adjustment between bottom surface 33 of slot 16, roller bearings, 35 fitting 29 and cutting box 14. And, the tapped holes of screw fasteners 30 and 31 are formed, for example, as so-called fitting bore holes which are drilled when assembling the apparatus. The screw threads in the bore holes may then be formed when assembling each cutting box.

As shown in FIG. 3, each cage 35 is shorter by dimensions 38 and 39 than the axial extent 40 of fitting piece 29 or cutting box 14. This difference in axial dimension can, for example, be as large as a division (pitch) 41 by which two cutting edges of cutting box 14 are spaced apart. Thus, cutting box 14 can be axially displaced or shifted along shaft 11 without cage 35 being disengaged from cutting box 14, and without the opposite ends of the cage extending outwardly of the cutting box, provided such axial displacement does not exceed dimension 41. It is also possible that the combination of dimensions 38 and 39, for example, approximate the spacing by which three adjacent cutting edges of the cutting box are spaced.

In each of the second grooves, a T-shaped pressure bar 42 is located and extends slightly outwardly thereof through openings 43 located in the shaft which communicate with the respective second grooves. And, at least one expandable tube or pillow 44, of elastic material or the like, is located in each second groove beneath its respective pressure bar 42, so as to lie between its pressure bar and the bottom of its groove, as shown. The interior of the tube is connected to supply passage 12 of the shaft by the provision of at least one bore hole 45. In such manner, pressure medium, for example compressed air, can be admitted via supply passage 12 so as to expand each of the tubes 44 which thereby displaces pressure bars 42 radially outwardly thereby pressing the pressure bars against the inner surface of the cutting box for fixing it axially in place after it is set in the desired axial position along the shaft. The pressure within tubes 44 can be released, prior to further axial adjustment, by admitting a vacuum into passage 12, or by any other well known manner, such as by suitable valving.

If the web to be cut should sag in gap 46 between a pair of adjacent cutting boxes, each end face of each cutting box can be provided with jaws 47, toothing or similar arrangements which are structured such that the adjacent cutting boxes can be displaced separately even if the jaws of the adjacent cutting boxes are engaged. In such manner it is assured that the web will not sag but will rather be supported at these areas where gaps exist between the cutting boxes. At the same time any marks in the web to be cut or at the cut strips, can be avoided.

From the foregoing, it can be seen that the lower cutters of an apparatus for longitudinally slitting a web can be smoothly and accurately adjusted axially of the support shaft on which they were mounted, are assured of rotating with the shaft about the shaft axis, and are fixed to the shaft in an axial direction after being displaced axially in a desired position. The lower cutter is mounted to permit such axial adjustment for both straight cut and looped cut operations, and the cutting boxes may be axially shifted in any desired format even during the cutting operation or during the web rewind operation.

Obviously, many modifications and variations are made possible in the light of the above teachings. It is therefore to be understood that within the scope of the appended claims the invention may be practiced otherwise than as specifically described.

What is claimed is:

1. In an apparatus for longitudinally slitting a continuous web, at least one lower, circular cutter mounted on a shaft adapted to be journalled on a machine frame for rotation, said cutter having a plurality of cutting grooves presenting a series of spaced cutting edges, means for setting said cutter in a desired position along said shaft, said means comprising at least one axially extending, outwardly open, flat bottom first groove in the outer periphery of said shaft, a fitting received in said groove and extending slightly outwardly thereof, said cutter overlying said fitting, said cutter being secured to said fitting for rotation together with said shaft, roller means disposed between and in contact with an inner surface of said fitting and the bottom of said groove to facilitate displacement of said cutter and said fitting in an axial direction of said shaft, said roller means comprising a flat roller cage containing a plurality of rollers, and said cage in said axial direction being shorter than the length of said cutter by an amount equal to at least the spacing between an adjacent pair of said cutting edges, whereby said cage will not extend outwardly of either end of said cutter upon said displacement in said axial direction.

2. In the apparatus according to claim 1, wherein at least one, axially extending, outwardly open, second groove is provided in said outer periphery of said shaft, a pressure bar received in said second groove and extending slightly outwardly thereof, said cutter overlying said bar, and exapandable means in said second groove underlying said pressure bar for pressing said bar against said cutter for preventing any axial shifting of said cutter after being set along said shaft.

3. In the apparatus according to claim 2, wherein said shaft is hollow, said expandable means comprises an expandable pillow, and mating pressure medium inlets in said pillow and said shaft for pressure filing said pillow.

* * * * *